US008444511B2

(12) United States Patent
Chen

(10) Patent No.: US 8,444,511 B2
(45) Date of Patent: May 21, 2013

(54) TABLE TENNIS SAFETY LOCK

(76) Inventor: Samuel Chen, Shanghai (CN)

( * ) Notice: Subject to any disclaimer, the term of this patent is extended or adjusted under 35 U.S.C. 154(b) by 94 days.

(21) Appl. No.: 13/279,073

(22) Filed: Oct. 21, 2011

(65) Prior Publication Data

US 2013/0102424 A1 Apr. 25, 2013

(51) Int. Cl.
*A63B 67/04* (2006.01)

(52) U.S. Cl.
USPC ..... 473/496

(58) Field of Classification Search
USPC ..... 473/496; 108/115, 118, 162, 166–176; 248/188, 188.1, 188.6
See application file for complete search history.

(56) References Cited

U.S. PATENT DOCUMENTS 3,777,674 A * 12/1973 Parsons ..... 108/175
6,321,664 B1 * 11/2001 Damour et al. ..... 108/168
8,007,378 B2 * 8/2011 Vallon et al. ..... 473/496

FOREIGN PATENT DOCUMENTS

CN 202151198 U * 2/2012
CN 202407735 U * 9/2012
DE 19853327 A1 * 5/2000

* cited by examiner

*Primary Examiner* — Raleigh W Chiu
(74) *Attorney, Agent, or Firm* — Clement Cheng

(57) ABSTRACT

A table tennis table with a safety latch includes: a table tennis table having a left panel and a right panel; a left leg swivel attached to the left panel; a right leg swivel attached to the right panel; a middle frame having vertical support members; and a safety latch installed on a vertical support member. The safety latch includes: a lock arm; a hook mounted to the lock arm; a spring biasing the lock arm and the hook to a closed position; and a shaft passing through the vertical support member. The lock arm is pivotally mounted to the shaft.

11 Claims, 4 Drawing Sheets

TABLE TENNIS SAFETY LOCK

FIELD OF THE INVENTION

The present invention involves table tennis safety lock.

DISCUSSION OF RELATED ART

Table tennis is a widely popular sport around the world and has a broad base. Many homes have a table tennis table for recreational enjoyment in a relaxing environment, and for providing a good fitness workout. Table tennis tables are large and therefore are typically made to fold. Typically, a pair of panels can be folded up so that the table can be placed in a corner position, not taking up too much space. Folding table tennis tables have shortcomings in that when they are in folded position, the panels may sometimes fall, which may not only damage the table tennis tables, but may also lead to some other safety incidents. At present, the current safety features are inconvenient and difficult to use.

SUMMARY OF THE INVENTION

A table tennis table with a safety latch includes: a table tennis table having a left panel and a right panel; a left leg swivel attached to the left panel; a right leg swivel attached to the right panel; a middle frame having vertical support members; and a safety latch installed on a vertical support member. The safety latch includes: a lock arm; a hook mounted to the lock arm; a spring biasing the lock arm and the hook to a closed position; and a shaft passing through the vertical support member. The lock arm is pivotally mounted to the shaft.

The table tennis table optionally includes a left safety latch and a right safety latch. The spring can be formed as a torsion spring mounted around a fixed post on the shaft. The shaft can be fixed to the vertical support member so that it does not rotate relative to the vertical support member. The spring is connected to a vertical support member at a first spring end and connected to the lock arm at a second spring end. The hook preferably faces up and is generally planar in a vertical plane. The hook may also have a pad that engages with a left panel top surface or a right panel top surface. The hook is preferably positioned in the arc path of either the left panel or the right panel.

The following call out list of elements is a useful guide and referencing the elements of the drawings.

1 Left Panel
2 Right Panel
3 Left Leg
4 Right Leg
5 Middle Frame
6 Left Safety Lock
7 Right Safety Lock
71 Lock Arm
72 Hook
73 Shaft
74 Torsion Spring
75 Pad

DETAILED DESCRIPTION OF THE PREFERRED EMBODIMENT

Figure 1:
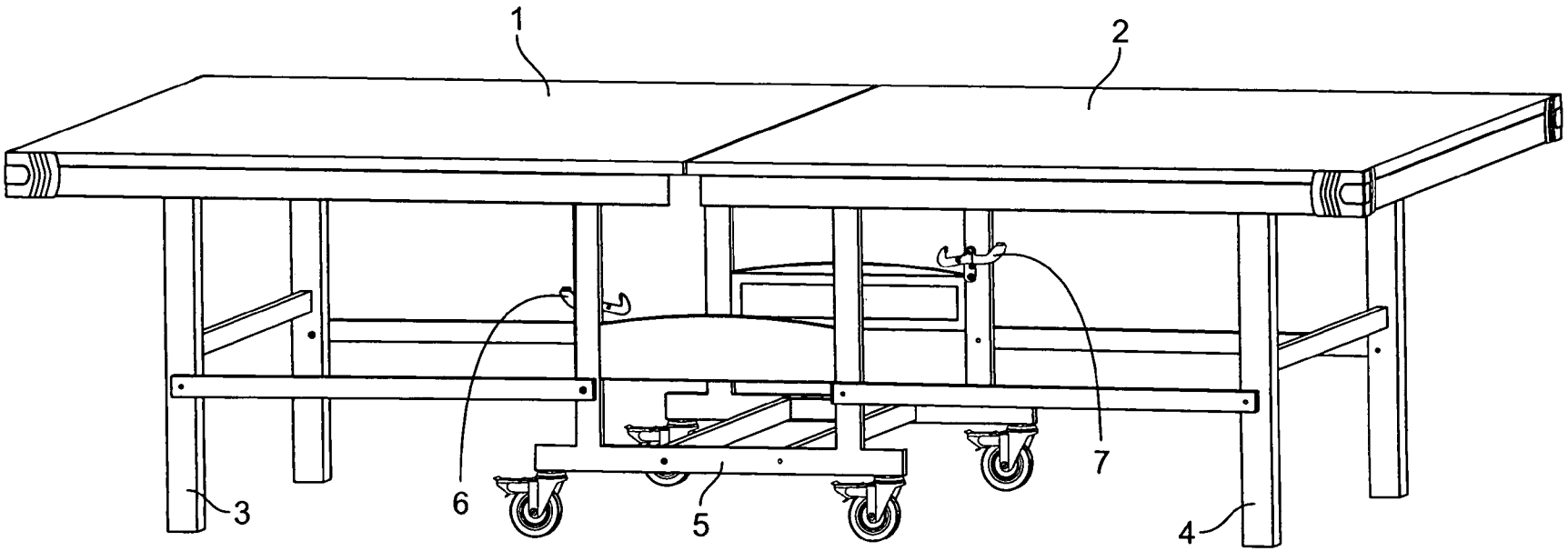
FIG. 1 shows a table tennis table in an expanded and deployed position.
Figure 2:
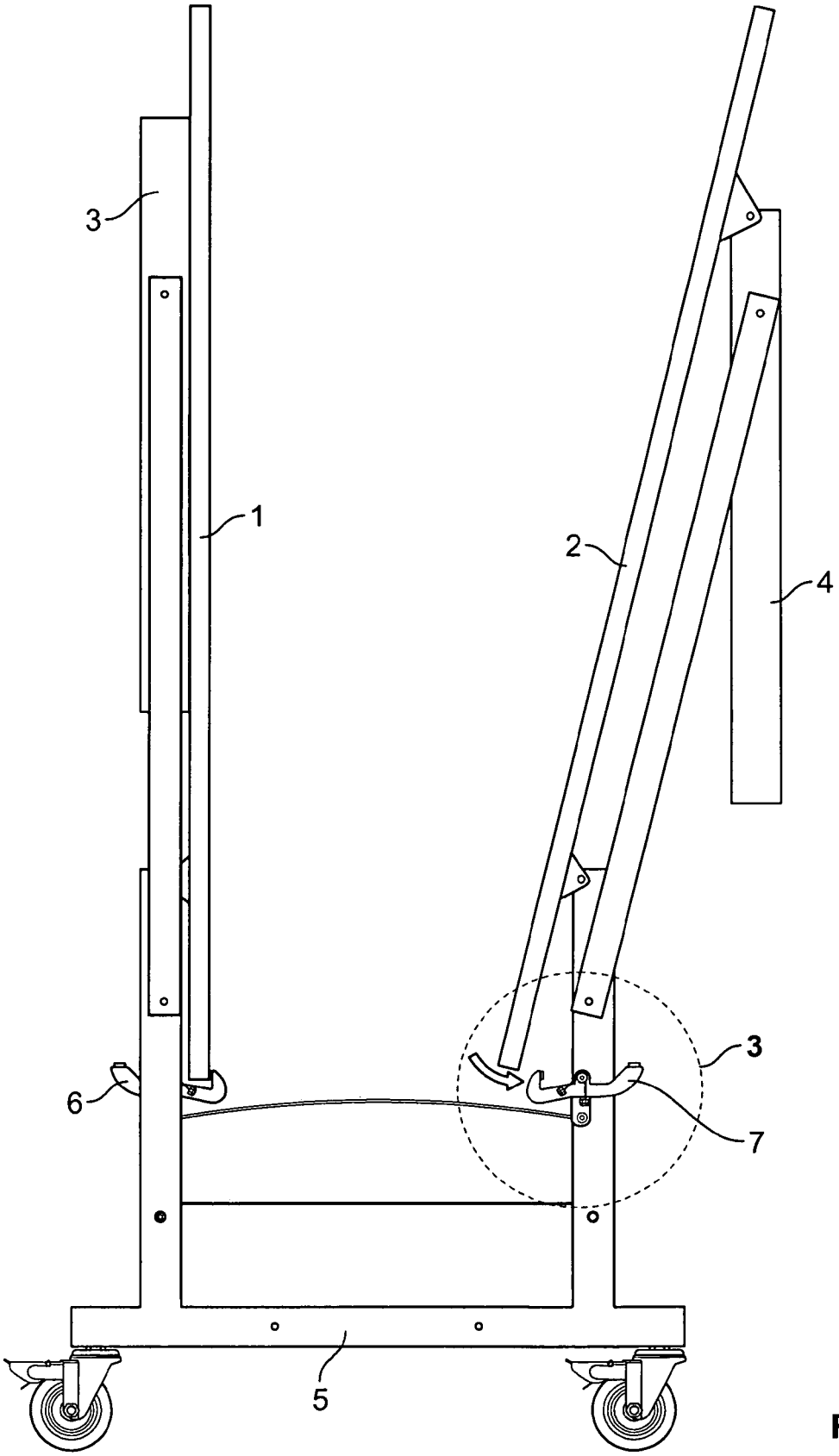
FIG. 2 shows the state diagram of the table tennis table being stowed in a stowed position.
Figure 3:
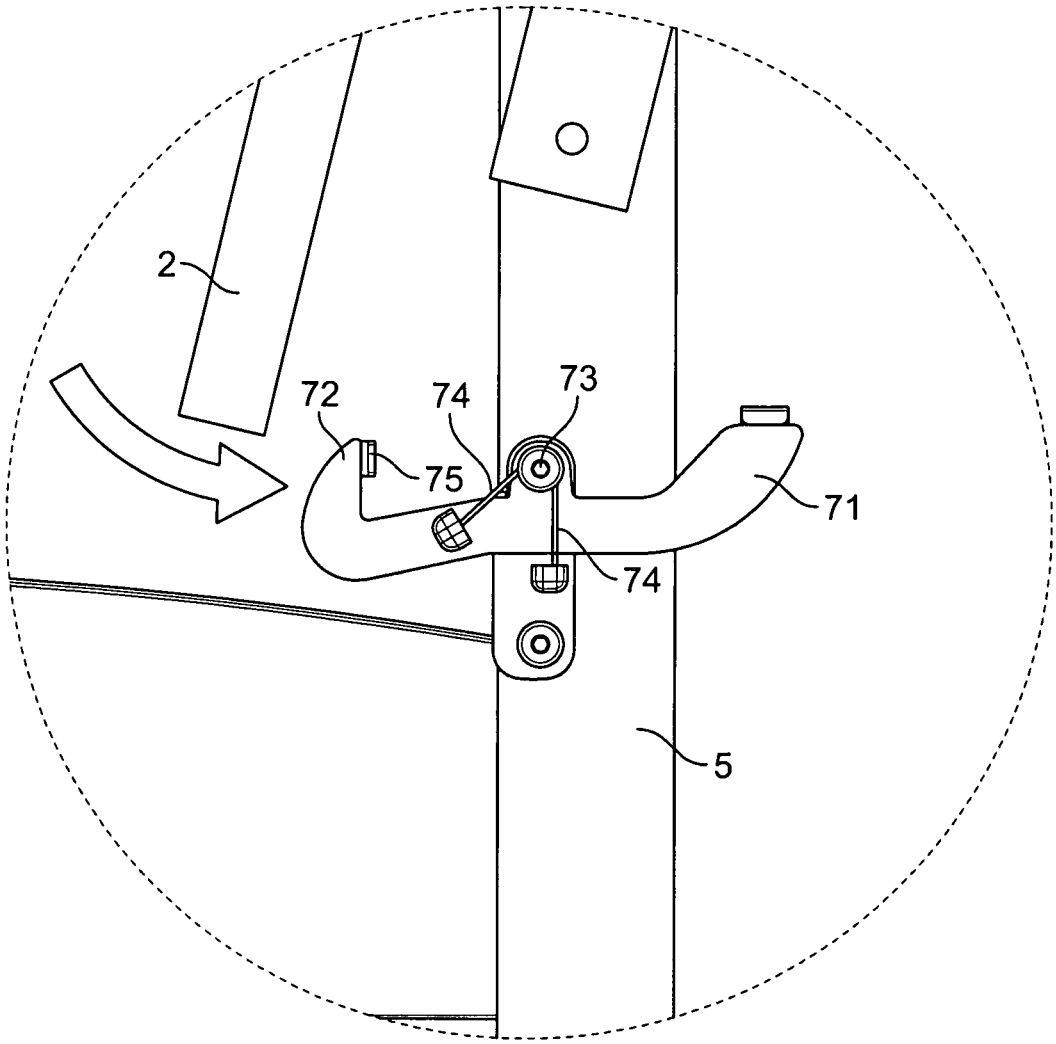
FIG. 3 is a partial enlarged diagram in FIG. 2.
Figure 4:
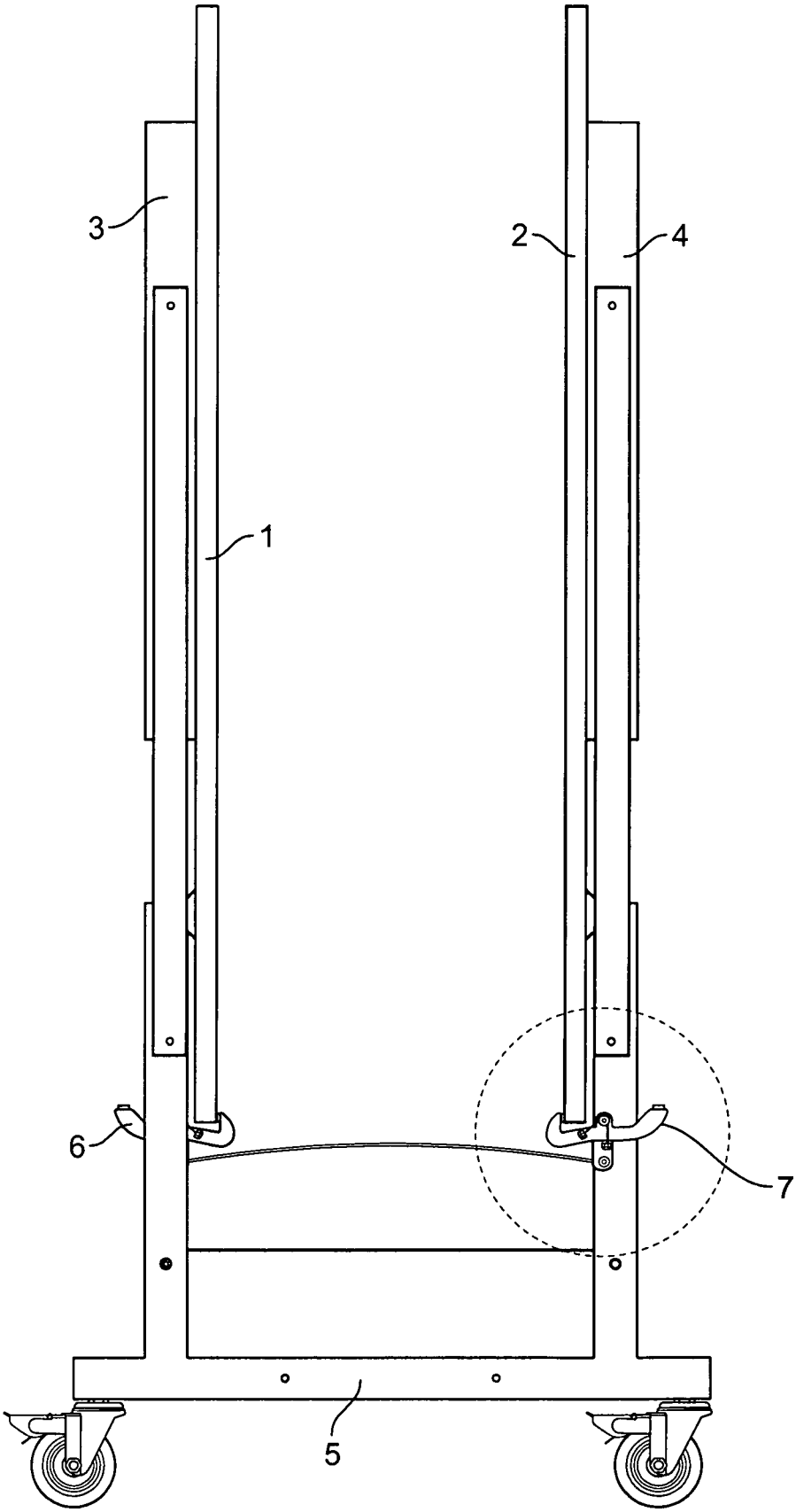
FIG. 4 is a diagram of the table tennis table in stowed position.

This embodiment, with reference to FIGS. 1-4 describes a security lock folding table tennis table. The table tennis table is generally symmetrical including the left panel 1 and right panel 2. The left panel 1 is installed to the left leg 3 and the right panel 2 is mounted on the right leg 4. The left leg 3 and right leg 4 both connect to the middle frame 5 via intermediate linkages. The middle frame 5 has vertical leg supports. The vertical leg supports include a left safety lock 6 mounted on the left vertical leg support and a right safety lock 7 mounted on the right vertical leg support.

Security locks are pivotally installed on the middle frame 5 on the left and right vertical leg supports. The left safety lock 6 and right safety lock 7 are preferably of the same general structure. The safety lock includes lock arm 71, hook 72 and the torsion spring 74. The lock arm 71 is pivotally mounted to a horizontal shaft 73 which extends through the vertical leg support of the middle frames 5. The left and right safety locks 6, 7 are located generally in the middle towards the middle of the table tennis table. A torsion spring 74 is mounted to the middle of a fixed ring affixed on the shaft 73. One end of torsion spring 74 is retained to the middle frame vertical leg support, such as by a pocket located on a bracket that is mounted to the middle frame vertical leg support. The other end of the torsion spring is retained to the lock arm 71 to bias the lock arm into a closed position.

Hook 72 has a curved hook structure. The hook 72 is offset from the vertical leg support by a thickness of the table panel. The hook 72 can be constructed of a sheet of metal having a bend at. pad 75 to face a top surface of a panel 2 when the hook 72 is engaged to a top surface of the panel 2. The lock arm 71 may have a bend at the opposite end from the hook 72 on an outside side of the lock arm 71. The bend may produce a button like surface for depressing downward to disengage the hook 72 from the panel 2. Lock hook 72 is generally planar and oriented in the vertical plane except for bends to provide a surface of pads 75 engagement with panel 2. The lock arm 71 and hook 72 can be made of metal, plastic or wood.

The edge of the hook 72 is located within the art of motion of the panel 2 so that the hook 72 is pushed downward by the panel 2 when the panel 2 is swinging to a closed position. The panel 2 locks into place such that the hook 72 springs back upward to bring the pad 75 in engagement or with a gap but facing a top surface of the panel 2. Thus, a user need only raise a panel to engage the locking latch. The locking latch can be manually operated by pulling up on the button surface of the lock 71 arm for releasing the latch hook 72 from the panel 2 while pulling on the panel to lower the panel 2 into a deployed position from a stowed position.

The present invention has been made more than a detailed description of the above, only the preferred embodiment of this invention example only, when not limited to the scope of the present invention, that is where the equality of changes made under this application and modification of the scope, are to be remain within the scope of the present invention.

The invention claimed is:

1. A table tennis table with a safety latch comprising:
a table tennis table having a left panel and a right panel
a left leg swivel attached to the left panel;
a right leg swivel attached to the right panel;
a middle frame having vertical support members;
a safety latch installed on a vertical support member and, wherein the safety latch comprises:

a lock arm;

a hook mounted to the lock arm;

a spring biasing the lock arm and the hook to a closed position;

a shaft passing through the vertical support member, wherein the lock arm is pivotally mounted to the shaft.

2. The table tennis table with a safety latch of claim 1, further comprising a left safety latch and a right safety latch.

3. The table tennis table with a safety latch of claim 1, wherein the spring is formed as a torsion spring mounted around a fixed post on the shaft, wherein the shaft is fixed to the vertical support member and does not rotate relative to the vertical support member.

4. The table tennis table with a safety latch of claim 1, wherein the spring is connected to a vertical support member at a first spring end and connected to the lock arm at a second spring end.

5. The table tennis table with a safety latch of claim 1, wherein the hook is facing up and is generally planar in a vertical plane.

6. The table tennis table with a safety latch of claim 1, wherein the hook further comprises a pad that engages with a left panel top surface or a right panel top surface.

7. The table tennis table with a safety latch of claim 1, wherein the hook is positioned in the arc path of either the left panel or the right panel.

8. The table tennis table with a safety latch of claim 1, further comprising a left safety latch and a right safety latch, wherein the hook is positioned in the arc path of either the left panel or the right, wherein the hook is facing up and is generally planar in a vertical plane.

9. The table tennis table with a safety latch of claim 1, wherein the spring is formed as a torsion spring mounted around a fixed post on the shaft, wherein the shaft is fixed to the vertical support member and does not rotate relative to the vertical support member, wherein the hook further comprises a pad that engages with a left panel top surface or a right panel top surface.

10. The table tennis table with a safety latch of claim 9, wherein the spring is connected to a vertical support member at a first spring end and connected to the lock arm at a second spring end.

11. The table tennis table with a safety latch of claim 1, further comprising a left safety latch and a right safety latch, wherein the hook is positioned in the arc path of either the left panel or the right, wherein the hook is facing up and is generally planar in a vertical plane, wherein the spring is formed as a torsion spring mounted around a fixed post on the shaft, wherein the shaft is fixed to the vertical support member and does not rotate relative to the vertical support member, wherein the hook further comprises a pad that engages with a left panel top surface or a right panel top surface.

* * * * *